US006899515B2

(12) United States Patent
Ahn et al.

(10) Patent No.: US 6,899,515 B2
(45) Date of Patent: May 31, 2005

(54) CROSS FLOW FAN AND AIR CONDITIONER FITTED WITH THE SAME

(75) Inventors: Cheol O Ahn, Seoul (KR); Sim Won Chin, Gwangmyong-shi (KR); Chang Seon Lee, Seoul (KR); Mun Kee Chung, Seoul (KR); In Cheol Yun, Anyang-shi (KR); Dong Soo Moon, Seoul (KR); In Hwa Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/413,396

(22) Filed: Apr. 15, 2003

(65) Prior Publication Data

US 2003/0194311 A1 Oct. 16, 2003

(30) Foreign Application Priority Data

Apr. 16, 2002 (KR) ..... 10-2002-0020677

(51) Int. Cl.[7] ..... F04D 5/00

(52) U.S. Cl. ..... 415/53.1; 416/184; 416/200 R

(58) Field of Search ..... 415/53.1, 53.2, 415/53.3; 416/200 R, 184, 187, 186 R

(56) References Cited

U.S. PATENT DOCUMENTS 5,573,059 A * 11/1996 Hamamoto et al. ..... 165/124
5,611,667 A 3/1997 Nagamori et al.
6,026,103 A * 2/2000 Oliver et al. ..... 372/37
6,149,381 A * 11/2000 Lee ..... 415/53.1
6,345,951 B1 * 2/2002 Choi ..... 415/1

FOREIGN PATENT DOCUMENTS

CN 1118843 A 3/1997

OTHER PUBLICATIONS

English Language Abstract of CN 1118843A.

* cited by examiner

*Primary Examiner*—Edward K. Look
*Assistant Examiner*—Igor Kershteyn
(74) *Attorney, Agent, or Firm*—Greenblum & Bernstein, P.L.C.

(57) ABSTRACT

Cross flow fan having a plurality of unit fans assembled in succession with the unit fans twisted from each other at sides, and an air conditioner fitted with the same. The unit fan includes an annular rim, and a plurality of impellers arranged on a side of the rim vertical to, and along a circumference of the rim. The present invention provides a cross flow fan extension lines from the impellers of the unit fan have a phase difference with the extension lines from the impellers of an adjacent unit fan. The air conditioner includes a casing having an inlet and an outlet, an indoor unit inclusive of an indoor heat exchanger provided in rear of the inlet inside of the casing, and a cross flow fan having a plurality of unit fans assembled at sides in succession, with the unit fans twisted from each other, the cross flow fan being provided inside of the casing, and the unit fan having an annular rim, and a plurality of impellers arranged on a side of the rim vertical to, and along a circumference of the rim, and an outdoor unit having an outdoor heat exchanger and a compressor, the outdoor unit connected to the indoor unit with refrigerant pipe.

24 Claims, 8 Drawing Sheets

FIG. 6

| number of impellers | twist angle between unit fans(Deg) |
|---|---|
| 30 | 6.05 ~ 6.25 |
| 31 | 5.85 ~ 6.05 |
| 32 | 5.65 ~ 5.85 |
| 33 | 5.50 ~ 5.70 |
| 34 | 5.30 ~ 5.50 |
| 35 | 5.15 ~ 5.35 |

CROSS FLOW FAN AND AIR CONDITIONER FITTED WITH THE SAME

This application claims the benefit of the Korean Application No. P2002-20677 filed on Apr. 16, 2002, which is hereby incorporated by reference.

BACKGROUND OF THE INVENTION

1. Field of the Invention

The present invention relates to cross flow fans and air conditioners, and more particularly, to a cross flow fan with more than two unit successive fans, and an air conditioner fitted with the same.

2. Background of the Related Art

The air conditioner is an appliance for cooling/heating a room by using heat absorption/discharge from/to an environment in phase change of a working fluid.

In general, the air conditioner is provided with an indoor unit and an outdoor unit. The outdoor unit is provided with an outdoor heat exchanger, an outdoor fan, and a compressor, and the indoor unit is provided with an indoor heat exchanger and a fan.

The compressor, the outdoor heat exchanger, and the indoor heat exchanger are connected with refrigerant pipe, and the refrigerant circulates the compressor, the outdoor heat exchanger, the indoor heat exchanger, and the compressor in succession through the refrigerant pipe. The indoor heat exchanger produces cold air as the refrigerant evaporates at the indoor heat exchanger and absorbs heat from an environment, which cold air is discharged to a room space by the fan, to cool down the room.

The fan fitted to the indoor unit of the air conditioner draws air through an inlet and discharge through an outlet. The air drawn into the indoor unit through the inlet is deprived of heat to become cold air as the air passes through the indoor heat exchanger, and discharged to the room space through the outlet.

Meanwhile, the fans employed for the air conditioners are sirocco fans, propeller fans, turbo fans, and cross flow fans, wherein the cross flow fans are mostly used in small sized air conditioners each having the indoor unit and the outdoor unit separated from each other.

The cross flow fan is provided with an annular rim, and a plurality of impellers arranged along a circumference of, and vertical to the rim. The cross flow fan is fitted to the indoor unit, so that the impellers draw air at an inlet side in a circumferential direction and discharge the air in the circumferential direction at an outlet side in the circumferential direction as the impellers are rotated.

In the meantime, a pressure around the impeller is varied with time at fixed intervals as the impellers rotate. Particularly, when the cross flow fan is rotated, there are sharp periodic variations of pressures in parts adjacent to a stabilizer and a rear guide. The periodic pressure variation causes noise at a particular frequency, according to which principle, loud noise emits from the cross flow fan fitted to the indoor unit at particular frequencies as shown in FIG. 1. For reference, FIG. 1 illustrates a graph showing a result of measurement done by a computer simulation of sound pressure levels of the cross flow fan with 32 impellers, wherein it can be noted that there are significantly high sound pressures of 30 dB and 25 dB at approx. 800 Hz and 1600 Hz, respectively.

Consequently, a supplementary design of the cross flow fan is required for improving a problem of causing significantly high noises at particular frequencies when the cross flow fan rotates.

SUMMARY OF THE INVENTION

Accordingly, the present invention is directed to a cross flow fan, and an air conditioner fitted with the same that substantially obviates one or more of the problems due to limitations and disadvantages of the related art.

An object of the present invention is to provide a cross flow fan, and an air conditioner fitted with the same, in which an amplitude of the period variation of environment pressure occurred during rotation of the cross flow fan is reduced for prevention of a high sound pressure generated at a particular frequency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the cross flow fan includes a plurality of unit fans assembled side by side in succession twisted from each other, wherein the unit fan includes an annular rim, and a plurality of impellers arranged on a side of the rim vertical to, and along a circumference of the rim.

In another aspect of the present invention, there is provided a cross flow fan having a plurality of unit fans assembled in a length direction in succession, wherein the unit fan includes an annular rim, and a plurality of impellers arranged on a side of the rim vertical to, and along a circumference of the rim, wherein the impellers of the unit fan is assembled such that imaginary horizontal extension lines from the impellers of the unit fan have a phase difference with the extension lines from the impellers of an adjacent unit fan.

In further aspect of the present invention, there is provided an air conditioner including a casing having an inlet and an outlet, an indoor unit including an indoor heat exchanger provided in rear of the inlet inside of the casing, and a cross flow fan having a plurality of unit fans assembled at sides in succession, with the unit fans twisted from each other, cross flow fan being provided inside of the casing, and an outdoor unit having an outdoor heat exchanger and a compressor, the outdoor unit connected to the indoor unit with refrigent pipe. The unit fan has an annular rim, and a plurality of impellers arranged on a side of the rim vertical to, and along a circumference of the rim The plurality of unit fans are assembled, for an example, by a predetermined twist angle it goes in a clockwise or anti-clockwise direction when the unit fans are seen from a side.

The plurality of unit fans are assembled, as another example, with a twist angle different from each other when the unit fans are seen from a side.

The impellers are arranged on the rim, for an example, at equal distances along a circumference of the rim, or the impellers are arranged on the rim, as another example, at unequal distances along a circumference of the rim.

The twist angle of the unit fan and a number of impellers have, for example, the following relation:

$-0.18Z+11.43<\delta<-0.18Z+11.633$, where, Z denotes a number of impellers, and $\delta$ denotes the twist angle.

The twist angle between the unit fans when the unit fan has 30 impellers is, for an example, 6.05°~6.25°. The twist angle between the unit fans when the unit fan has 31 impellers is, for an example, 5.85°~6.05°. The twist angle between the unit fans when the unit fan has 32 impellers is, for an example, 5.65°~5.85°. The twist angle between the unit fans when the unit fan has 33 impellers is, for an example, 5.50°~5.70°. The twist angle between the unit fans when the unit fan has 34 impellers is, for an example, 5.30°~5.50°. The twist angle between the unit fans when the unit fan has 35 impellers is, for an example, 5.15°~5.35°.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 6 illustrates a table of a twist angle between unit fans for different number of impellers in a cross flow fan of the present invention;

DETAILED DESCRIPTION OF THE PREFERRED EMBODIMENT

The cross flow fan of the present invention has a plurality of stages, i.e., a plurality of unit fans are assembled in succession to form one cross flow fan. Though a related art cross flow fan has unit fans assembled such that extension lines of impellers coincide, the cross flow fan of the present invention has unit fans assembled such that the unit fans are twisted to each other, or extension lines of impellers does not coincide.

Once the cross flow fan is assembled thus, the environmental periodic pressure variation occurred when the cross flow fan is in operation can be reduced, enabling removal of a sound pressure peak occurred at a particular frequency, which reduces the noise generated when the cross flow fan is rotated. That is, by dispersing the periodic noise at the particular frequency to adjacent frequencies, the sound pressure peak, along with the noise, can be reduced.

Reference will now be made in detail to the preferred embodiments of the present invention, examples of which are illustrated in the accompanying drawings. In describing the embodiments of the present invention, same parts will be given the same names and reference symbols, and repetitive description of which will be omitted.

Figure 1:
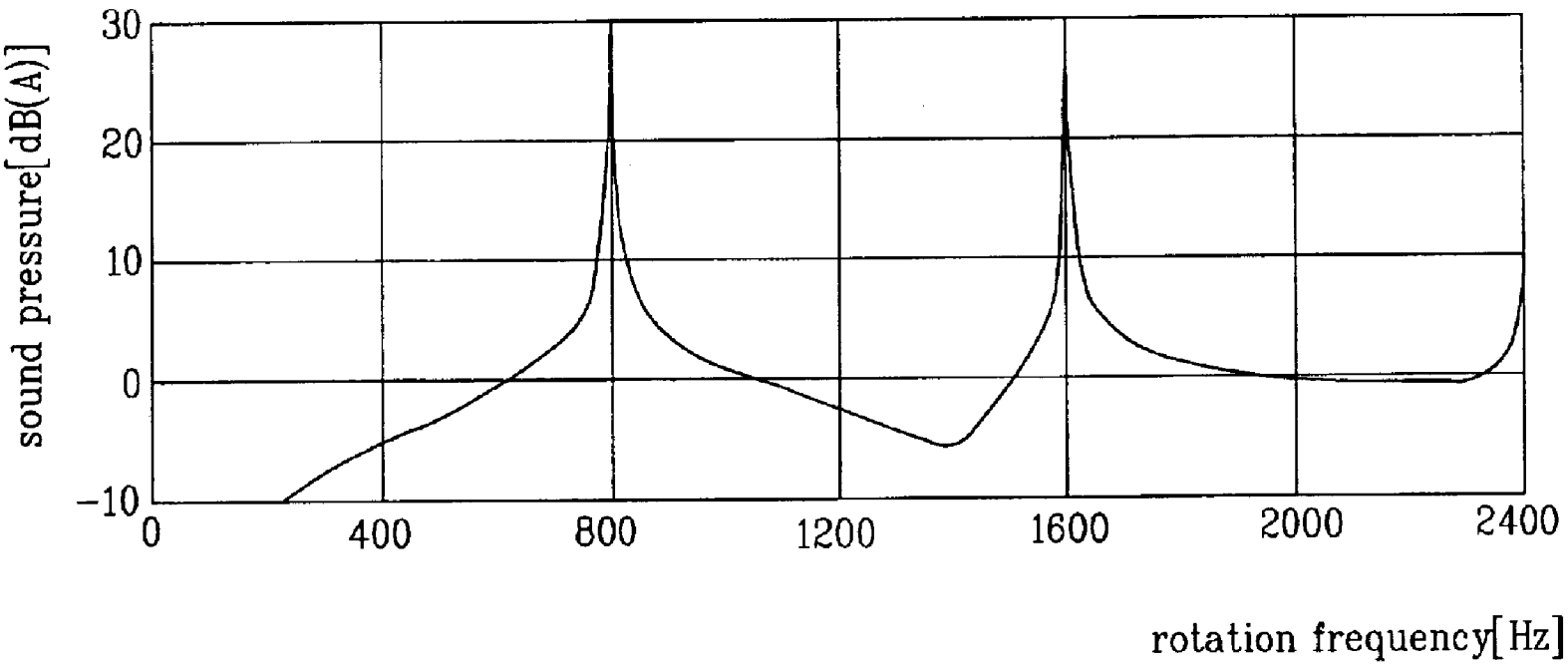
FIG. 1 Prior Art
FIG. 1 illustrates a graph of a sound pressure level vs. a frequency of a related art cross flow fan.
Figure 2:
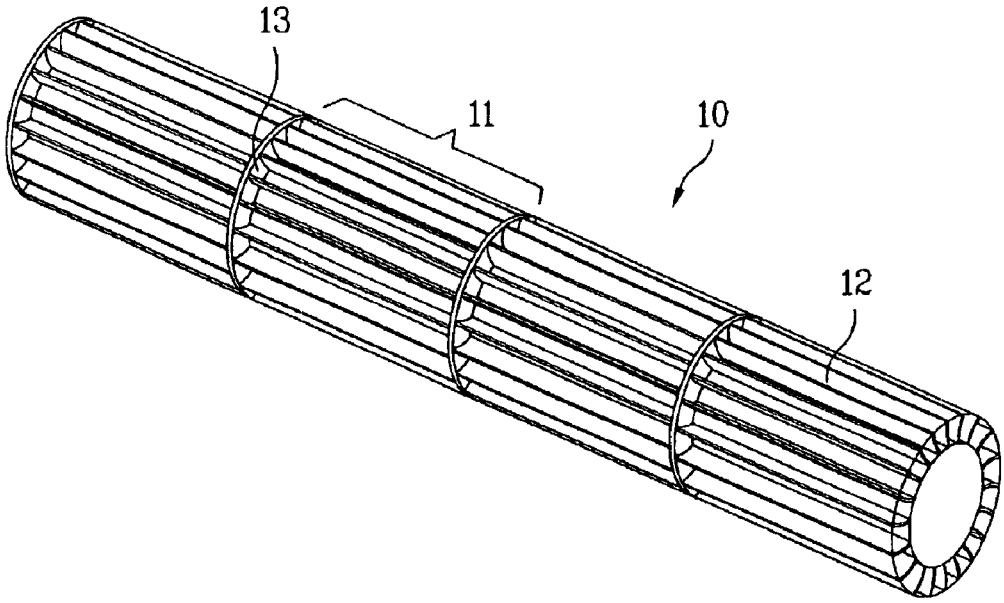
FIG. 2 illustrates a perspective view of a cross flow fan in accordance with a preferred embodiment of the present invention, schematically.

Referring to FIG. 2, the cross flow fan 10 of the present invention has a plurality of unit fans 11 assembled side by side, i.e., along a length direction in succession twisted with respect to each other.

Figure 3:
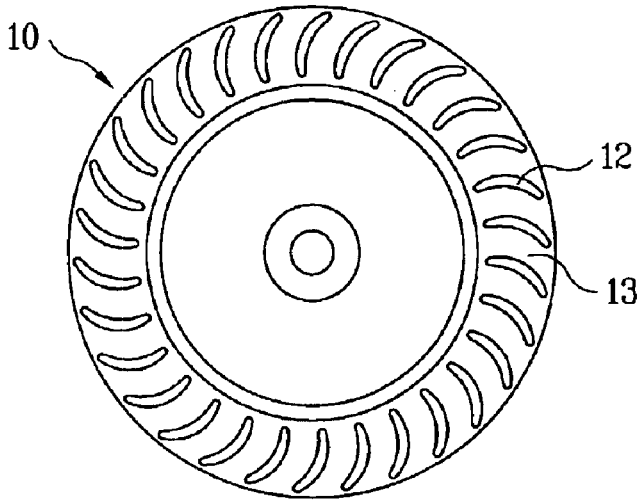
FIG. 3 illustrates a side view of a cross flow fan in accordance with a preferred embodiment of the present invention, schematically.

Referring to FIGS. 2 and 3, the unit fan 11 includes an annular rim 13, and a plurality of impellers (i.e., blades) 12 arranged transverse to, and along a circumference of the rim 13. As shown in FIG. 3, the impeller (i.e., blade) 12 is arranged on a side of the rim 13 at equal distances along the circumference of the rim 13, or, though not shown, at unequal distances along the circumference of the rim 13. That is, a pitch angle between two impellers (i.e., blades) 12 with respect to an angular point at a center of the rim 13 of the cross flow fan of the present invention is the same or different from each other for all impellers (i.e., blades) 12 of the cross flow fan 10 of the present invention.

Referring to FIG. 2, the unit fans 11 are assembled at the side of the rim 13 in succession with a twist angle to each other. In this instance, the unit fans 11 are assembled such that the unit fans 11 are twisted from each other by a predetermined angle as it goes farther in a clockwise or anti-clockwise direction when seen from the sides. However, the present invention is not limited to it, but the unit fans 11 may be assembled such that the unit fans 11 are twisted in an angle different from each other when seen from the sides.

Meanwhile, the present invention provides the following structure for easy assembly of the unit fans 11.

When the rim 13 is fitted to both ends of the impeller 12, to form one unit fan 11, the rim at the left end of the impeller 12 is provided with a projection (not shown), and the rim at the right end of the impeller 12 is provided with a groove (not shown) for receiving the projection. Thus, once the projection and the groove are provided to each rim which is to be fitted to ends of the impeller 12, accurate assembly positions can be found easily by inserting the projection into the groove in assembly of the plurality of unit fans 11. Of course, it is required that the projections and the grooves are provided to positions taking the twist angles of the unit fans 11 into account.

In the meantime, a structure slightly different from above can be provided. In a case the rim 13 is attached to one end of the impeller 12, what is only required is formation of impeller grooves (not shown) in opposite sides of the rim 13 at positions different from each other for fitting the impellers 12. That is, what is only required is that the impeller grooves are provided to a left surface of the rim 13 for inserting and fastening the impellers 12, and other impeller grooves are provided to a right surface of the rim 13 such that the impeller grooves in the right surface have a phase difference from the impeller grooves in the left surface. If the impeller grooves in opposite sides of the rim 13 have a phase difference from each other respectively, the impellers 12 of one of the unit fans 11 have the phase differences from the impellers 12 of an adjacent unit fan 11 automatically when the impellers 12 are fitted to the impeller grooves in the rim 13.

Once the foregoing structure is provided, the assembly is very convenient and productivity is improved, as the unit fans 11 can be assembly with easy.

Figure 4:
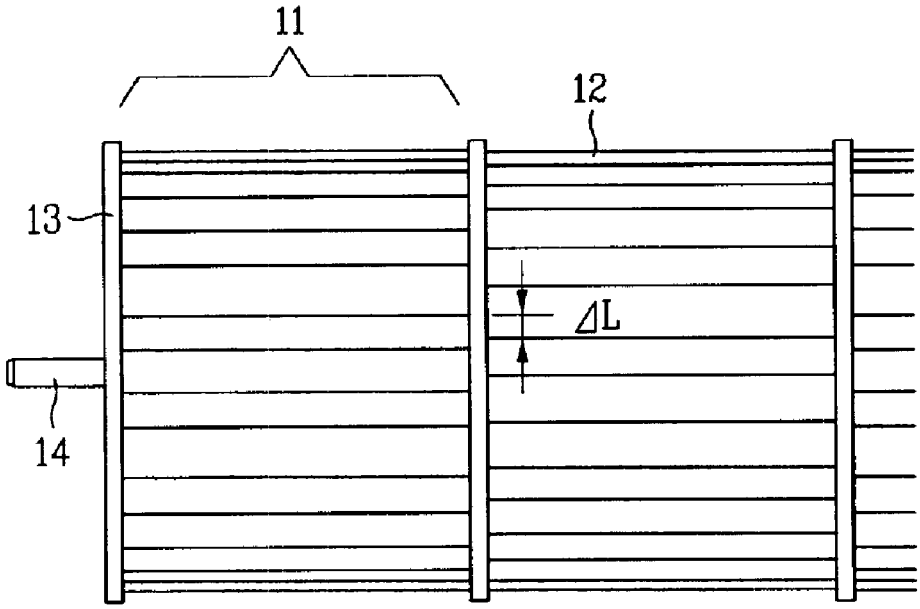
FIG. 4 illustrates a front view of a cross flow fan in accordance with a preferred embodiment of the present invention, schematically.

In the meantime, in the cross flow fan of the present invention, there can be an embodiment other than the embodiment in which the unit fans 11 are assembled with the unit fans 11 twisted to each other. That is, all the unit fans 11 are assembled into one cross flow fan, such that imaginary horizontal extension lines from the impellers 12 of the unit fan 11 have a phase difference with the same from the impellers 12 of an adjacent unit fan 11. In this instances, the phase difference may be represented with ΔL as shown in FIG. 4. Thus, if the extensions lines of the impellers 12 of the unit fans 11 do not coincide, which reduces the environmental periodic sound pressure variation occurred in rotation of the cross flow fan, leading to remove the sound pressure peak occurred at a particular frequency, the object of the present invention can be achieved.

Thus, the rims 13 are provided at both longitudinal ends of the cross flow fan 10 of an assembly of a plurality of unit fans 11. In FIG. 2, one of the rims provided to one end of the cross flow fan 10 is not illustrated for giving a clearer view of fitting of the impellers 12. As shown in FIG. 4, there is a shaft 14 provided to the rim at both ends of the cross flow fan 10 for connection to a driver.

Figure 5:
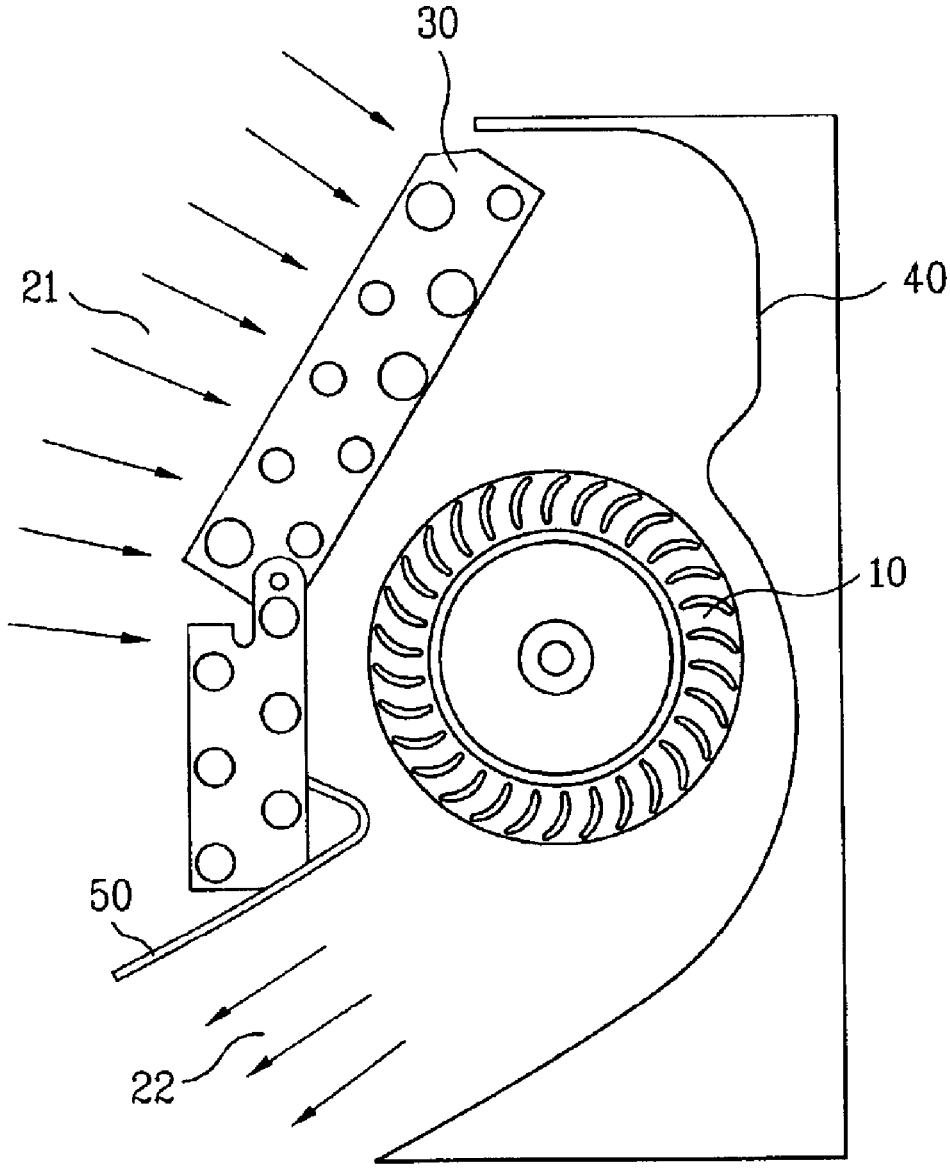
FIG. 5 illustrates a diagram of an inside structure of an indoor unit of an air conditioner in accordance with a preferred embodiment of the present invention, schematically.

In the meantime, the air conditioner of the present invention includes an indoor unit and an outdoor unit. The indoor unit includes a casing, an indoor heat exchanger, a cross flow fan, and the outdoor unit includes an outdoor heat exchanger and a compressor. The indoor unit and the outdoor unit are connected with refrigerant pipe. FIG. 5 illustrates an indoor unit schematically, referring to which the air conditioner of the present invention will be described in more detail.

The casing of the indoor unit includes an inlet 21 and an outlet 22. As shown in FIG. 5, inside of the casing, there is an indoor heat exchanger at a rear of the inlet 21. There is a stabilizer 50 provided at the outlet 22, and a rear guide 40 at a rear of the inside of the casing. The cross flow fan 10 of the present invention is provided between a rear guide 40 and the stabilizer 50. As the cross flow fan 10 has been described already, description of the cross flow fan 10 will be omitted, herein.

Referring to FIG. 5, the cross flow fan 10 in the indoor unit rotates in a clockwise direction to draw air through the inlet 21 and discharge the air through the outlet 22. In this instance, the air drawn through the inlet 21 is deprived of heat to turn to cold air as the air passes through the indoor heat exchanger 30, flows into the cross flow fan 10 through between the impellers 12 in a radial direction of the cross flow fan, moves to a side of the outlet 22 as the cross flow fan 10 rotates, and is discharged out of the cross flow fan 10 again in the radial direction. Meanwhile, the cross flow fan 10 causes a vortex in rotation of the cross flow fan 10, which is guided and altered to a static pressure by the rear guide 40, to minimize noise caused by the vortex. The stabilizer 50 provided in the vicinity of the outlet 22 separates an inlet 21 region from an outlet 22 region, and stabilizes an air flow toward the outlet 22.

In the air conditioner with the foregoing indoor unit, the refrigerant flows through the compressor of the outdoor unit, the outdoor heat exchanger, the indoor heat exchanger, and the compressor of the indoor unit in succession. In this instance, the refrigerant compressed to a high pressure at the compressor dissipates condensing heat at the outdoor heat exchanger to condense into a liquid phase, and transferred to the indoor heat exchanger of the indoor unit. The refrigerant transferred to the indoor heat exchanger 30 heat exchanges with the air introduced through the inlet 30 and vaporizes at the indoor heat exchanger 30, when the air introduced into the inlet 21 is cooled as a heat of the vaporization is absorbed from the air. The cooled air is supplied to a room through the outlet 22 and cools the room. The refrigerant passed through the indoor heat exchanger 30 is introduced into the compressor, and repeats the foregoing process, to cool down the room. Opposite to this, if the refrigerant is circulated in opposite direction in the air conditioner after a few elements are added to the air conditioner, the refrigerant absorbs heat at the outdoor heat exchanger, and dissipates condensing heat at the indoor heat exchanger. If the heat dissipated from the indoor heat exchanger is discharged to the room by rotating the cross flow fan 10, the air conditioner acts as a room heater. Because an air conditioning system which can cool or heat a room is in general used widely, the specification omits any further description of the air conditioning system.

In the meantime, the present invention suggests providing an optimal twist angle between unit fans 11 in the foregoing cross flow fan of the air conditioner, which will be described.

The particular frequency (BPF=blade passing frequency) at which the peak sound pressure occurs during rotation of the cross flow fan 10 can be defined as the following equation:

$$f_{BPF} = \frac{NZ}{60},$$

where, 'N' denotes revolutions per minute, and 'Z' denotes a number of impellers.

From the equation, it can be known that the BPF is proportional to the revolution per minute and the number of impellers.

In the meantime, the peak sound pressure at the BPF is derived as a function of the number of impellers, the twist angle between the unit fans, a length of the unit fan, and a number of the unit fans. In the present invention, a computer simulation is conducted using above parameters, to derive an optimal twist angle between the unit fans 11. The computer simulation is conducted based on 30~35 impellers 12 in the unit fan 11.

A result of the computer simulation is shown in a table illustrated in FIG. 6. That is, the twist angle δ deg. between the unit fans 11 when the unit fan 11 has 30 impellers is 6.05°~6.25°, the twist angle δ deg. when the unit fan 11 has 31 impellers is 5.85°~6.05°, the twist angle δ deg. when the unit fan 11 has 32 impellers is 5.65°~5.85°, the twist angle δ deg. when the unit fan 11 has 33 impellers is 5.50°~5.70°, the twist angle δ deg. when the unit fan 11 has 34 impellers is 5.30°~5.50°, and the twist angle δ deg. when the unit fan 11 has 35 impellers is 5.15°~5.35°.

Figure 7:
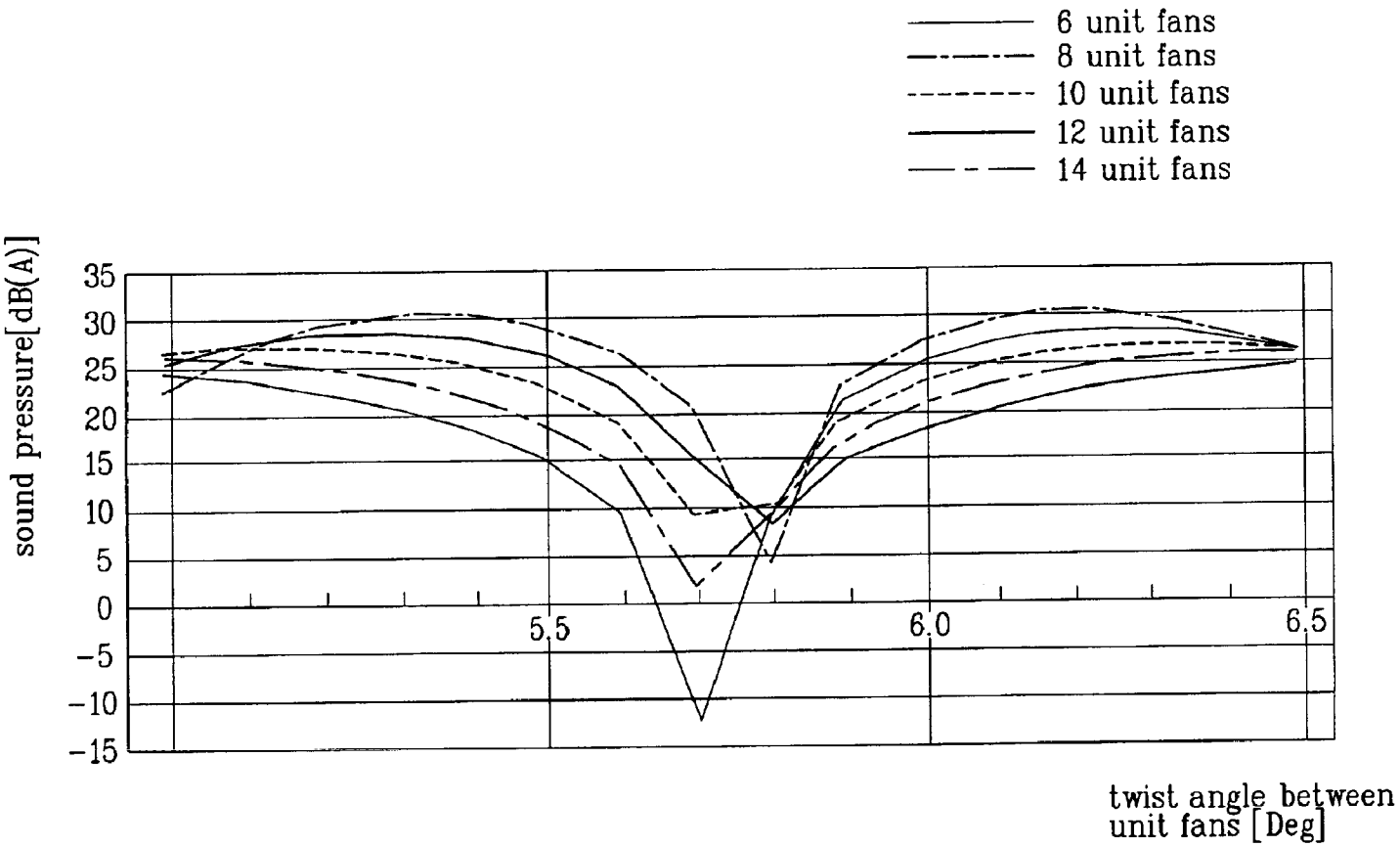
FIG. 7 illustrates a graph showing a twist angle between unit fans each with 32 impellers in a cross flow fan of the present invention versus a sound pressure.

In the meantime, FIG. 7 illustrates a result of computer simulation taking a cross flow fan 10 as one example, in which 32 impellers 12 are arranged in the unit fan at unequal pitches, and the unit fan 10 has a length of 55~65 mm. Referring to FIG. 7, it can be noted that the cross flow fan 10 shows no significant difference of the sound pressure variation even if the number of the unit fans 10 differs as 6, 8, 10, 12, or 14. It can also be noted that the cross flow fan 10 with 32 impellers 12 has the sound pressure significantly dropped at the BPF when the twist angle between the unit fans 10 is designed to have a range of 5.65~5.85.

As a result of the computer simulation, it is known that the length of the unit fan and the number of unit fans have little influence to the result. It is also known that the arrangements of the impellers either in equal pitches or unequal pitches have little influence to the result. Eventually, the result of the computer simulation for the twist angle δ deg. between the unit fans 11 can be simplified as a function of the number of impeller 'Z' as the following simple inequality.

$-0.18Z+11.43<\delta<-0.18Z+11.633$

Figure 8:
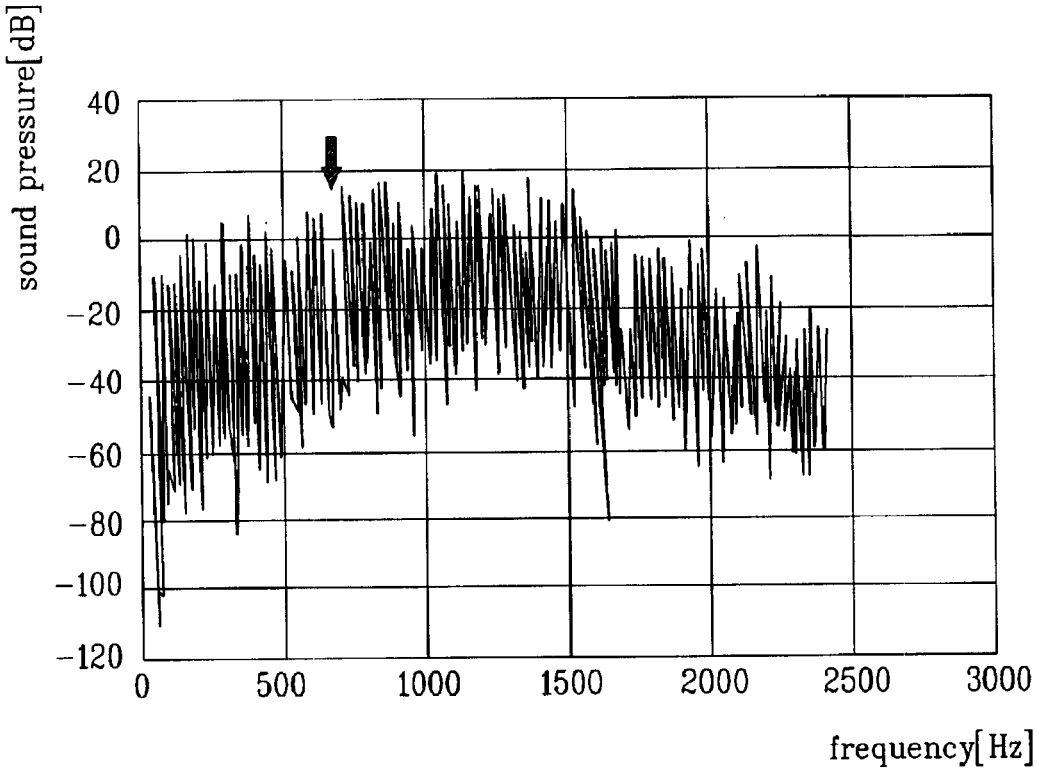
FIG. 8 illustrates a graph showing a frequency vs. a sound pressure when a twist angle between unit fans is optimized in a cross flow fan of the present invention.

In the meantime, FIG. 8 illustrates a graph showing a frequency vs. sound pressure when a twist angle between unit fans is optimized in a cross flow fan with unequal pitched impellers 12. Referring to FIG. 8, it can be noted that, in the cross flow fan 10 of the present invention in which the twist angle between unit fans 11 is optimized, the peak sound pressure occurs at 800 Hz range frequency in the related art is eliminated completely to show uniform sound pressures below 20 dB, which are lower than the related art, in all frequency ranges.

Figure 9:
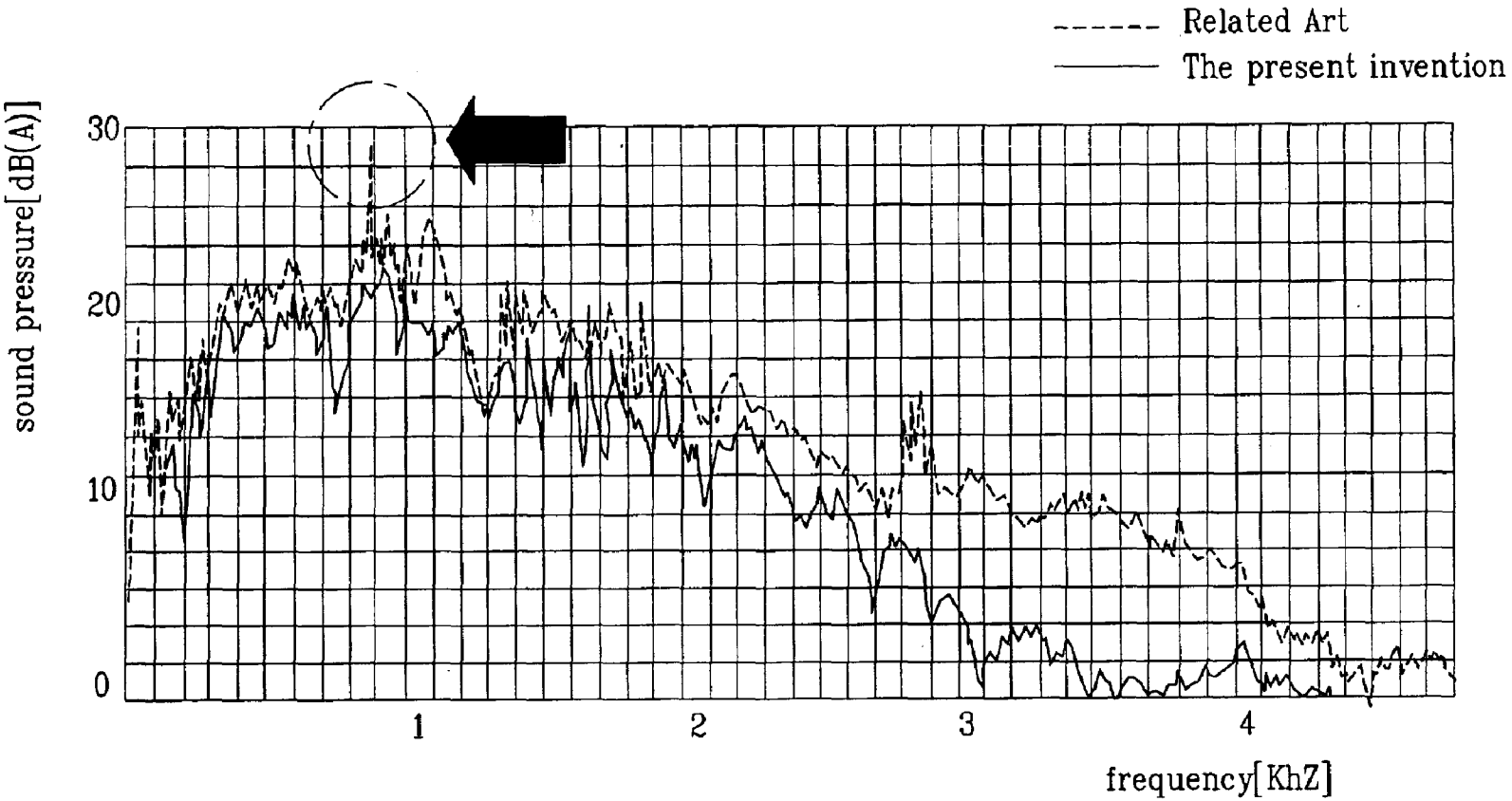
FIG. 9 illustrates a comparative graph of a frequency vs. a sound pressure of cross flow fans of the related art and the present invention when a twist angle between unit fans is optimized in a cross flow fan of the present invention.

FIG. 9 illustrates a comparative graph of a frequency vs. a sound pressure of cross flow fans of the related art and the present invention when a twist angle between unit fans is optimized in the cross flow fan of the present invention, wherein the dashed line denotes a graph of the sound pressure variation of the related art cross flow fan, and the solid line denotes a graph of the sound pressure variation of the cross flow fan of the present invention. Referring to FIG. 9, it can be noted that the peak sound pressure occurred at 800 Hz frequency is completely eliminated in the cross flow fan of the present invention.

Thus, the cross flow fan of the present invention can eliminate the noises generated at particular frequencies effectively by assembling the unit fans such that the unit fans are twisted to each other or extension lines of the impellers of the unit fan has a phase difference from extension lines of the impellers of an adjacent unit fan, which reduces the environmental periodic sound pressure variation when the cross flow fan rotates, and removes the peak sound pressure.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A cross flow fan having a plurality of unit fans configured to be successively in a side by side relation and staggered with respect to each other, wherein the unit fan comprises:

an annular rim; and a plurality of impellers arranged on a side of the rim transverse to, and along a circumference of the rim, wherein an angle of stagger between adjacent unit fans and a number of impellers have the following relationship:

$-0.18Z+11.43<\delta<-0.18Z+11.633$ where, Z denotes a number of impellers, and δ denotes the angle of stagger.

2. The cross flow fan according to claim 1, wherein the plurality of unit fans are configured, with a predetermined angle of stagger with respect to each other when the unit fans are viewed from a side.

3. The cross flow fan according to claim 2, wherein the plurality of unit fans are configured, by a predetermined angle of stagger in a clockwise direction when the unit fans are viewed from a side.

4. The cross flow fan according to claim 2, wherein the plurality of unit fans are configured, by a predetermined angle of stagger in a counter-clockwise direction when the unit fans are viewed from a side.

5. The cross flow fan according to claim 1, wherein the plurality of unit fans are configured, with an angle of stagger different from each other when the unit fans are viewed from a side.

6. The cross flow fan according to claim 1, wherein the impellers are arranged on the rim at equal distances along a circumference of the rim.

7. The cross flow fan according to claim 1, wherein the impellers are arranged on the rim at unequal distances along a circumference of the rim.

8. The cross flow fan according to claim 1, wherein an angle of stagger between the unit fans when the unit fan has 30 impellers is 6.05°~6.25°.

9. The cross flow fan according to claim 1, wherein an angle of stagger between the unit fans when the unit fan has 31 impellers is 5.85°~6.05°.

10. The cross flow fan according to claim 1, wherein an angle of stagger between the unit fans when the unit fan has 32 impellers is 5.65°~5.85°.

11. The cross flow fan according to claim 1, wherein an angle of stagger between the unit fans when the unit fan has 33 impellers is 5.50°~5.70°.

12. The cross flow fan according to claim 1, wherein an angle of stagger between the unit fans when the unit fan has 34 impellers is 5.30°~5.50°.

13. The cross flow fan according to claim 1, wherein an angle of stagger between the unit fans when the unit fan has 35 impellers is 5.15°~5.35°.

14. A cross flow fan having a plurality of unit fans assembled in a length direction in succession, wherein a unit fan comprises:

an annular rim; and a plurality of impellers arranged on a side of the rim transverse to, and along a circumference of the rim, wherein the impellers of one unit fan are configured such that imaginary horizontal extension lines from the impellers of the unit fan have a phase difference with imaginary horizontal extension lines from the impellers of an adjacent unit fan, wherein the phase difference between the unit fans and a number of impellers have the following relation:

$-0.18Z+11.43<\delta<-0.18Z+11.633$ where, Z denotes a number of impellers, and δ denotes the phase difference.

15. A cross flow fan having a plurality of unit fans successively assembled and staggered with respect to each other at an angle of stagger in one of a clockwise direction and a counter clockwise direction, wherein the unit fan comprises:

an annular rim; and a plurality of impellers arranged on a side of the rim transverse to, and along a circumference of the rim, wherein the angle of stagger of one unit fan with respect to an adjacent fan unit and a number of impellers have the following relationship:

$-0.18Z+11.43<\delta<-0.18Z+11.633$ where, Z denotes a number of impellers, and δ denotes an angle of stagger.

16. An air conditioner comprising:

a casing having an inlet and an outlet;

an indoor unit;

an indoor heat exchanger provided at a rear of the inlet inside of the casing, and a cross flow fan having a plurality of unit fans assembled in a side-by-side relation and staggered with respect to each other, the cross flow fan being provided inside of the casing, and each unit fan having an annular rim, and a plurality of impellers arranged on a side of the rim transverse to, and along a circumference of the rim; and an outdoor unit having an outdoor heat exchanger and a compressor, the outdoor unit connected to the indoor unit with refrigerant pipe, wherein an angle of stagger of one unit fan and an adjacent unit fan and a number of impellers have the following relationship:

$-0.18Z+11.43<\delta<-0.18Z+11.633$ where, Z denotes a number of impellers, and δ denotes an angle of stagger.

17. The air conditioner according to claim 16, wherein the plurality of unit fans are configured, with a predetermined angle of stagger to each other when the unit fans are viewed from a side.

18. The cross flow fan according to claim 16, wherein the plurality of unit fans are assembled, with an angle of stagger different from each other when the unit fans are viewed from a side.

19. The cross flow fan according to claim 16, wherein an angle of stagger between the unit fans when the unit fan has 30 impellers is 6.05°~6.25°.

20. The cross flow fan according to claim 16, wherein an angle of stagger between the unit fans when the unit fan has 31 impellers is 5.85°~6.05°.

21. The cross flow fan according to claim 16, wherein an angle of stagger between the unit fans when the unit fan has 32 impellers is 5.65°~5.85°.

22. The cross flow fan according to claim 16, wherein an angle of stagger between the unit fans when the unit fan has 33 impellers is 5.50°~5.70°.

23. The cross flow fan according to claim 16, wherein an angle of stagger between the unit fans when the unit fan has 34 impellers is 5.30°~5.50°.

24. The cross flow fan according to claim 16, wherein an angle of stagger between the unit fans when the unit fan has 35 impellers is 5.15°~5.35°.

* * * * *